United States Patent [19]

Spangenberg

[11] Patent Number: 4,667,723

[45] Date of Patent: May 26, 1987

[54] CORD LOCK

[75] Inventor: Robbert E. Spangenberg, Oosterhout, Netherlands

[73] Assignee: Hunter Douglas International, N. V., Curacao, Netherlands

[21] Appl. No.: 910,563

[22] Filed: Sep. 22, 1986

Related U.S. Application Data

[63] Continuation of Ser. No. 562,539, Dec. 19, 1983, abandoned.

[30] Foreign Application Priority Data

Jun. 22, 1983 [GB] United Kingdom ..... 8316962

[51] Int. Cl.[4] ..... E06B 9/38

[52] U.S. Cl. ..... 160/178 C

[58] Field of Search ..... 160/178 C, 168 R

[56] References Cited

U.S. PATENT DOCUMENTS

| | | | |
|---|---|---|---|
| 2,091,033 | 8/1937 | Dodge | 160/168 R X |
| 2,129,606 | 9/1938 | Nisenson | 160/168 |
| 2,840,157 | 6/1958 | Lorentzen | 160/168 R X |
| 3,799,236 | 3/1974 | Debs | 160/178 C |
| 4,180,118 | 12/1979 | Vecchiarelli | 160/178 C |
| 4,245,688 | 1/1981 | Vecchiarelli | 160/178 C |
| 4,327,797 | 5/1982 | Nakajima et al. | 160/178 C |

FOREIGN PATENT DOCUMENTS

| | | | |
|---|---|---|---|
| 1545111 | 5/1979 | United Kingdom | 160/178 C |

*Primary Examiner*—Ramon S. Britts
*Assistant Examiner*—David M. Purol
*Attorney, Agent, or Firm*—Pennie & Edmonds

[57] ABSTRACT

A cord lock for a blind, such as a venetian blind in which the body 10 is inserted in an aperture 12 in headrail 14. The body is retained by a U-shaped metal element 40, at least one of the two legs, 44, 46 of which serve the purpose, in addition to holding the body in the headrail, of acting as a wear resistant guide for the cords 25 to be locked. The other leg can be used as a cord separator.

14 Claims, 6 Drawing Figures

CORD LOCK

This is a continuation of application Ser. No. 562,539 filed Dec. 19, 1983, now abandoned.

The present invention relates to a cord lock for mounting in a blind headrail aperture.

Very many forms of such cord lock have been proposed in the past. The locks are usually used to lock the lift cord which is used to raise and lower the blind. In recent years attempts have been made to simplify and reduce the cost of the cord locks by making them, at least in part, from a plastics material. One example of such a cord lock is illustrated in the British Patent Specification No. 1 545 111. In this construction on the body of the cord lock is made of a plastics material and the cord lock comprises two rollers, preferably made of metal, and between which the cord passes, these rollers acting as a cord locking mechanism. The body of the cord lock includes a passage through which one or more cords may pass to and from the cord locking mechanism. The cords are separated by a pin or rod which spans the opening and extends longitudinally outwardly beyond the body and has end portions engaged against the inside surface of the headrail to hold the cord lock in place. In this connection the cord lock is provided with a peripheral flange which abuts the outer surface of the headrail and this, together with the pin or rod fixedly retains the cord lock in the headrail.

Such a contruction is of considerable advantage over known cord locks but has the rather serious problem that the cord tends to wear the plastics material, by abrasion of the cord against the sides of the opening in the body.

It is now proposed, according to the present invention, to provide a cord lock for mounting in a blind headrail aperture, said cord lock comprising a body with outer body portions shaped to overlap edges of said aperture, separate fixing means for cooperating with said body and with the headrail inner surface, fixedly to hold said cord lock in place, a cord-locking mechanism mounted within said body and a passage in said body for passing at least one cord to and from said cord-locking mechanism, said body having locating means for cooperating with said separate fixing means and said separate fixing means being formed by a generally U-shaped element, having two legs each of which is sized to bridge an exit opening of the passage, the arrangement of said locating means and said U-shaped element being such that, in the mounted position of the cord lock in the headrail, at least one leg of said U-shaped element will run parallel to one edge of said exit opening and can serve as a wear resisting cord guide over which said at least one cord can pass, thereby to prevent said cord from causing abrasive wear on said body.

The cord lock of the present invention provides a simple and inexpensive structure and at least one of the legs of the U-shaped element can lie adjacent an edge of the exit opening, to act as a guide against which the cord may bear to prevent wear of the plastics material by the cord.

Advantageously, the cord lock is formed of a transparent plastics material and the U-shaped element is formed of metal. Transparent plastic material is of advantage since it enables one to use the standard body for all blinds, irrespective of the colour of the headrail, because the cord lock will, because of its transparent properties, effectively take up the colour of the headrail. Unfortunately, transparent plastics materials tend to be rather soft and with the construction of the present invention, the otherwise normally excessive wear is completely prevented.

In one embodiment of a cord lock according to the present invention the locating means allow mounting of the U-shaped element in two different positions, one for one orientation of the cord lock in the blind headrail and the other for a second orientation. Preferably the locating means comprise three holes in the body, in each of two walls, one on either side of the opening, one leg of the U-shaped element being engagable in one of said holes in each wall in both positions of the element, to hold the cord lock in place in the headrail, the other leg being engagable in the second and third holes, respectively, to act as said wear resisting cord guide.

In a simple construction, the holes are located at the apices of isosceles right-angled triangles.

One leg of the U-shaped element can be made longer than the other, so that when one is changing from one orientation to the other, this leg can act as a pivot, facilitating the insertion of the other leg. The end of the longer leg will act to extend beyond the edge of the aperture on the inside of the blind headrail to retain the cord lock in place.

In another embodiment, the locating means allow mounting of the U-shaped element in a position in which said two legs act jointly to hold said cord lock in place in the headrail and one leg and the other leg respectively serve as a wear resisting cord guide for one and the other respectively of two opposite edges of said exit opening of the cord passage. In this way the same lock can be used without any modification in either orientation, i.e. at the left-hand or right-hand side of a headrail. Preferably the cord lock further comprises an independent separator pin mounted on the body to bridge the exit opening of said passage at a central location parallel to the legs of the U-shaped element.

With the construction of the present invention, the insertion of the U-shaped element effects in one manipulative step, the provision of a wear resistant part, along the side of the exit opening of the passage for the cord, and also the securing of the cord lock in the blind headrail.

In order that the present invention may more readily be understood, the following description is given, merely by way of example, reference being made to the accompanying drawings, in which.

Figure 1:
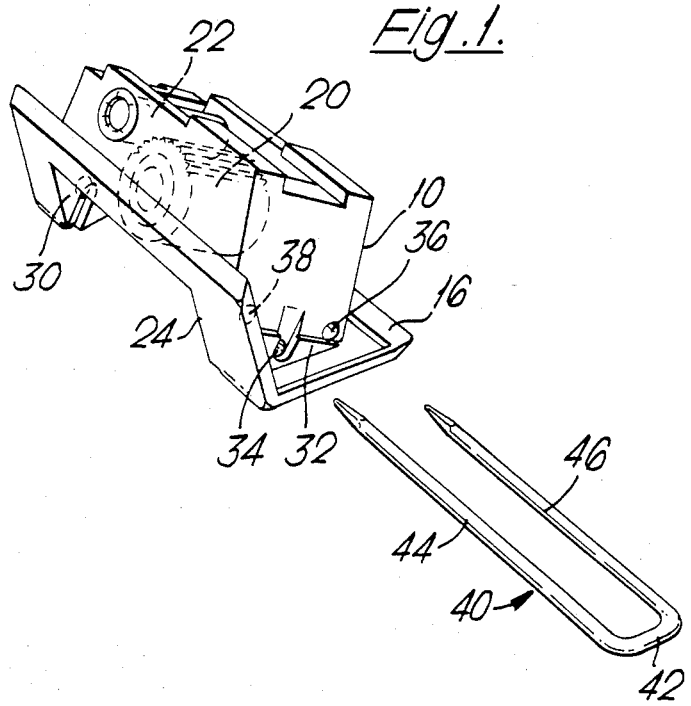
FIG. 1 is a perspective view of one embodiment of cord lock according to the invention, with the U-shaped element shown removed from the cord lock body.
Figure 2:
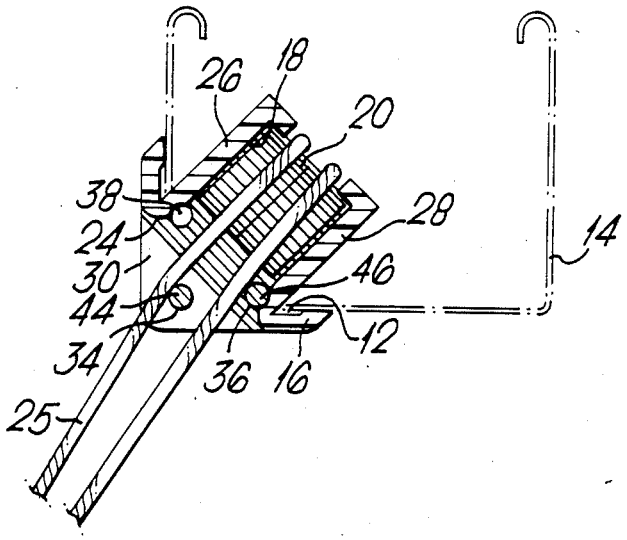
FIG. 2 is a section through the lock of FIG. 1 and shown mounted in an aperture in a headrail.

Referring first to FIGS. 1 and 2, the cord lock is shown comprising a body 10 inserted in an aperture 12 at the junction of the bottom and a side wall of a channel section venetian blind headrail 14, indicated in phantom. The body 10 is provided with an outer body portion in the form of a peripheral flange 16 shaped to overlap edges of the aperture 12.

A passage 18 is formed within the body 10 and mounted therein are a freely moveable toothed roller pair 20 and a generally fixed roller 22, these being, in use, on substantially parallel axes.

At its lower end of the passage 18 is provided with an opening 24 through which passes cords 25 to be locked, these cords passing over the roller 20, and between rollers 20 and 22. The passage 18 is formed by side walls 26 and 28 and end walls 30 and 32. Formed in the two end walls 30 and 32 are three holes 34, 36 and 38, these being at the apices of isosceles right-angled triangles. Slidable engagable in these holes are the legs 44, 46 of a U-shaped metal element 40 having a web portion 42. The spacing between the two legs 44 and 46 is equal to the spacing between the hole 34 and the hole 36, or the hole 34 and the hole 38. Thus the U-shaped element can be inserted in the holes 34 and 36 as shown in FIG. 2 or in the holes 34 and 38 as shown in FIG. 3.

The leg 44 is longer than the leg 46 and is also longer than the maximum length of the flange 16 of the body 10. Thus as can be seen in FIG. 4 the web 42 and the end 45 of the leg 44 extend beyond the flange 16. Thus, when inserted in the headrail as illustrated in FIG. 2 or FIG. 3 the element 40 can be used to retain the body within the headrail because it will be engaged against the inner surface of the headrail. The element 40 has three other functions. Firstly, it retains the roller pair 20 within the opening 18 and it also serves as a separator to separate the two cords 25. Finally, and more importantly, it prevents the cords 25 from abrading the body as the cords pass through the opening 24, and thereby prevents any wear to the body. This is particularly important if the body is formed of a plastics material, especially a transparent plastics material, such materials tending to be rather soft.

Figure 3:
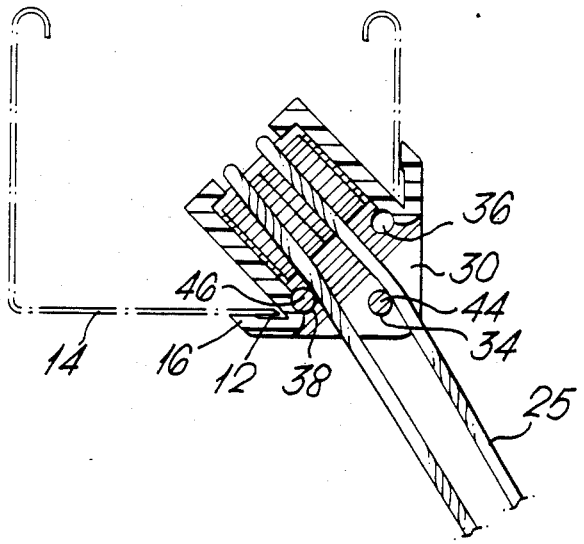
FIG. 3 is a view similar to FIG. 2 shown mounted in an aperture on the other side of the headrail.
Figure 4:
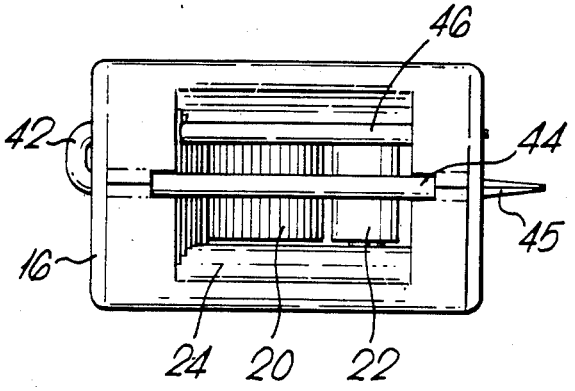
FIG. 4 is an underneath plan of the cord lock of FIGS. 1, 2 and 3.

As mentioned, the lock can be mounted in the position of FIG. 2 or the position of FIG. 3 so that it can either be at the left or right hand side of a head rail. The leg 44 is longer than the leg 46; conversion from one position to another is facilitated because one can insert the pin 44 first, in the hole 44 and then rotate or pivot the element so that the end of the leg 46 engages in either the hole 36 or the hole 38.

Figure 5:
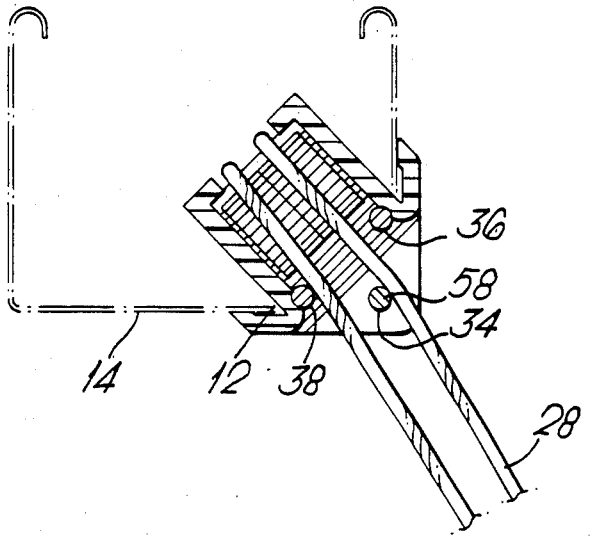
FIG. 5 is a view similar to FIG. 3 illustrating a second embodiment of cord lock according to the invention.
Figure 6:
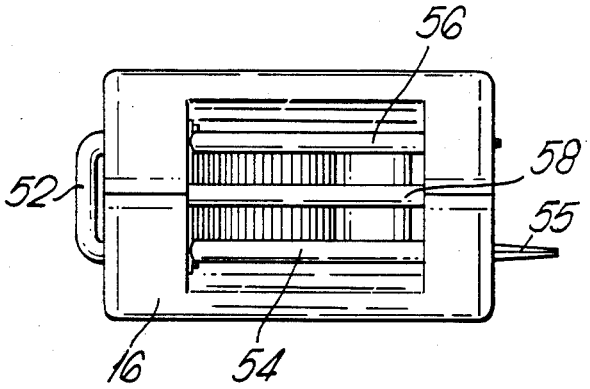
FIG. 6 is an underneath plan of the cord lock of FIG. 5.

In the modified structure shown in FIGS. 5 and 6, the body is substantially identical but the U-shaped element has a wider spacing between its legs 54 and 56 so that these can be engaged in the holes 36 and 38, but not the hole 34. Again the length of the leg 54 is greater than the length of the peripheral flange 16 of the body so that the web 22 and the end 55 of the leg 54 project longitudinally therebeyond, as in FIG. 4. An independent separator pin 58 is engaged in the hole 34 and serves to separate the two parts of the cord 25. With this arrangement it is not necessary to adjust the position of the U-shaped element so that the same locks can be used for left or right hand mounting.

I claim:

1. A cord lock for mounting in a blind headrail aperture in combination with a cord having a given diameter, said cord lock comprising a body with opposite side walls, end walls and outer body portions shaped to overlap edges of said aperture, separate fixing means attachable to said body in a first position for cooperating with said body and with the headrail inner surface to fixedly hold said cord lock in a mounted position in the headrail, a cord-locking mechanism mounted within said body and a passage in said body having an exit opening for passing at least one cord into said cord lock and to and from said cord-locking mechanism, said exit opening being defined by said opposite side walls of the body and the outer body portions, and said body having locating means for locating said separate fixing means in said first position; the improvement wherein:

(a) said separate fixing means is a generally U-shaped element, having two legs each of which is sized to bridge said exit opening of the passage;

(1) one of which is disposed in said first position in said locating means and extends in close parallel relationship to one side wall of said exit opening defining a dimension therebetween less than the diameter of said cord to isolate the outer body portion defined thereby from engagement with the cord passing therethrough so as to serve as a wear resisting cord guide over which the cord passes and thereby prevents said cord from causing abrasive wear on said body portion, and (2) the other leg of which extends in spaced parallel relationship to the one side wall of the exit opening between said one leg and the other side wall of the opening to define a space between said legs for the passage of said cord and to isolate the other side wall from engagement with the cord passing between said legs.

2. A cord lock according to claim 1, wherein said locating means allow mounting said U-shaped element in two different positions, one for one orientation of the cord lock in the blind headrail and the other for a second orientation.

3. A cord lock according to claim 2, wherein the locating means comprise three holes in said body, in each of two end walls, one at either end of the exit opening, one leg of the U-shaped element being engageable in one of said holes in each end wall in both positions of the element, to hold the cord lock in place in the headrail, the other leg being engageable in the second and third holes, respectively, to act as wear resisting cord guide.

4. A cord lock according to claim 3, wherein the holes are located at the apices of isosceles right-angled triangles.

5. A cord lock according to claim 1 wherein said one leg of the U-shaped metal element which is engageable in said one of said holes is longer than the other leg.

6. A cord lock according to claim 1, wherein said locating means allow mounting of said U-shaped element in a position in which said two legs act jointly to hold said cord lock in place in the headrail and one leg and the other leg respectively serve as the wear resisting cord guide for one and the other of the two opposite side walls of said exit opening of the cord passage.

7. A cord lock according to claim 6, and further comprising an independent separator pin mounted on said body to bridge the exit opening of said passage at a central location parallel to the legs of said U-shaped element.

8. A cord lock according to claim 1, wherein the body is formed from a transparent plastics material and the U-shaped element is formed of metal.

9. A cord lock according to claim 1, wherein the locating means includes:

(a) first openings in the body of the cord lock through which said one leg of said U-shaped element extends when in said first position, said first openings being located closely adjacent to the one side wall of said exit opening; and (b) second openings in said body through which said one leg of the U-shaped element can extend when attached to said body in a second position in close parallel relationship to the other side wall of said exit opening opposite said one side wall, said second openings being located closely adjacent to said other side wall, and said one leg isolating the other side wall of said exit from engagement with said cord passing therethrough.

10. A cord lock according to claim 9 wherein:

(a) the locating means includes third openings in said body for receiving the other leg of said U-shaped element when the first leg thereof is received in either of said first or second openings; and (b) the spacing between the first and third openings is equal to the spacing between the second and third openings and unequal the spacing between the first and second openings.

11. A cord lock according to any one of claims 1, 9 or 10 wherein:

(a) the spacing between the one leg of the U-shaped element and the closely parallel side wall of the exit opening when said leg is in said first or second position is less than the thickness of said cord to prevent passage therebetween.

12. A cord lock for mounting in a blind headrail aperture, said cord lock comprising a body with opposite side walls, and wall and outer body portions shaped to overlap edges of said aperture, separate fixing means attachable to said body in a first position for cooperating with said body and with the headrail inner surface to fixedly hold said cord lock in a mounted position in the headrail, a cord-locking mechanism mounted within said body and a passage in said body having an exit opening for passing at least one cord into said cord lock and to and from said cord-locking mechanism, said exit opening being defined by said opposite side walls of the body and the outer body portions, and said body having locating means for locating said separate fixing means in said first position, the improvement wherein:

(a) said separate fixing means in a generally U-shaped element, having two legs each of which is sized to bridge said exit opening of the passage and one of which is disposed within one of said locating means in said first position in abutting parallel relationship to one side wall of said exit opening to isolate the side wall and outer body portion defined thereby from engagement with the cord passing therethrough so as to serve as a wear resisting cord guide over which the cord passes and thereby prevent said cord from causing abrasive wear on said body portion.

13. A cord lock for mounting in a blind headrail aperture in combination with a cord means for operating the blind, said cord lock comprising a body with opposite side walls, end walls and outer body portions shaped to overlap edges of said aperture, separate fixing means attachable to said body in a first position for cooperating with said body and with the headrail inner surface to fixedly hold said cord lock in a mounted position in the headrail, a cord-locking mechanism mounted within said body and a passage in said body having an exit opening for passing said cord means into said cord lock and to and from said cord-locking mechanism, said exit opening being defined by said opposite side wall of the body and the outer body portions, and said body having locating means for locating said separate fixing means in said first position; the improvement wherein:

(a) said separate fixing means is a generally U-shaped element, having two legs each of which is sized to bridge said exit opening of the passage;

(b) one of said legs is disposed in said first position in said locating means and extends in close parallel relationship to one side wall of said exit opening;

(c) said cord means comprises at least one cord having a diameter which passes through said exit opening and along a path between the legs of said fixing means and isolated from engagement with the one side wall by the one leg which leg serves as a wear resisting cord guide over which the one cord passes and thereby prevents said one cord from causing abrasive wear on said one side wall; and (d) the other leg of said fixing means extends in spaced parallel relationship to the one side wall of the exit opening between said one leg and the other side wall of the opening to define a space between said legs greater than the one cord diameter for the passage of said one cord and to isolate the other side wall from engagement with the one cord passing between said legs.

14. A cord lock according to claim 13 wherein:

(a) the cord means includes a second cord passing through the exit opening of said cord lock and through the space between the other leg of said fixing means and the other side wall of the exit opening; and (b) the other leg of the fixing means isolates the two cords from each other as they pass through the cord lock.

* * * * *

UNITED STATES PATENT AND TRADEMARK OFFICE

CERTIFICATE OF CORRECTION

PATENT NO. : 4,667,723

DATED : May 26, 1987

INVENTOR(S) : Robbert E. Spangenberg

It is certified that error appears in the above-identified patent and that said Letters Patent is hereby corrected as shown below:

On the Title Page: [73] Assignee: line 2

"Curacao, Netherlands" should read --Curacao, Netherlands Antilles--.

Signed and Sealed this

Third Day of May, 1988

*Attest:*

*Attesting Officer*

DONALD J. QUIGG

*Commissioner of Patents and Trademarks*